US012680208B2

(12) United States Patent
Detty et al.

(10) Patent No.: US 12,680,208 B2
(45) Date of Patent: Jul. 14, 2026

(54) NARROW GAUGE HOLLOW NEEDLE IMPROVEMENT

(71) Applicants: Jason Daniel Detty, Chattanooga, TN (US); Keith England, Chattanooga, TN (US); Michael Morgante, Chattanooga, TN (US)

(72) Inventors: Jason Daniel Detty, Chattanooga, TN (US); Keith England, Chattanooga, TN (US); Michael Morgante, Chattanooga, TN (US)

(73) Assignee: Tuftco Corporation, Chattanooga, TN (US)

( * ) Notice: Subject to any disclaimer, the term of this patent is extended or adjusted under 35 U.S.C. 154(b) by 21 days.

(21) Appl. No.: 18/387,522

(22) Filed: Nov. 7, 2023

(65) Prior Publication Data

US 2024/0150949 A1 May 9, 2024

Related U.S. Application Data

(60) Provisional application No. 63/423,638, filed on Nov. 8, 2022.

(51) Int. Cl.
*D05C 15/18* (2006.01)
*D05C 15/14* (2006.01)

(52) U.S. Cl.
CPC ..... *D05C 15/18* (2013.01); *D05C 15/145* (2013.01)

(58) Field of Classification Search
CPC ..... D05C 15/16; D05C 15/18; D05C 15/20; D05C 15/145
See application file for complete search history.

(56) References Cited

U.S. PATENT DOCUMENTS

| | | | | |
|---|---|---|---|---|
| 3,356,047 | A * | 12/1967 | Short | D05C 15/00 223/102 |
| 3,361,095 | A * | 1/1968 | Short | D05C 15/00 112/260 |
| 4,503,787 | A * | 3/1985 | Watkins | D05C 15/145 112/80.55 |
| 4,549,496 | A | 10/1985 | Kile | |
| 4,991,523 | A | 2/1991 | Ingram | |
| 5,588,383 | A | 12/1996 | Davis et al. | |
| 7,318,383 | B1 | 1/2008 | Ingram | |
| 8,141,505 | B2 | 3/2012 | Hall et al. | |
| 8,359,989 | B2 | 1/2013 | Hall et al. | |
| 2007/0283863 | A1* | 12/2007 | Ingram | D05C 15/26 112/80.4 |
| 2017/0356113 | A1* | 12/2017 | Amos | D05C 17/026 |

* cited by examiner

*Primary Examiner* — Nathan E Durham
(74) *Attorney, Agent, or Firm* — Miller & Martin PLLC

(57) ABSTRACT

A method for tufting lower loop heights than prior art machines could tuft with a hollow needle tufting machine is disclosed. Polishing and/or rounding edges of needles, which may be smaller in diameter than prior art needles were implemented with a straight edge backing bar, and dimensionally stable woven backing fabric to provide consistently lower loops than prior art efforts.

18 Claims, 8 Drawing Sheets

NARROW GAUGE HOLLOW NEEDLE IMPROVEMENT

CLAIM OF PRIORITY

This application claims the benefit of U.S. Provisional application No. 63/423,638 filed Nov. 8, 2023, which is incorporated herein by reference in its entirety.

FIELD OF THE INVENTION

The present invention relates to tufting apparatus for producing patterned textile goods such as carpet, upholstery, and the like, and more particularly to tufting apparatus utilizing hollow needles to which a plurality of yarns are selectively fed.

BACKGROUND OF THE INVENTION

In many hollow needle tufting machines, as typified by Kile, U.S. Pat. No. 4,549,496 and Davis, at al., U.S. Pat. No. 5,588,383, both of which are incorporated herein by reference in their entirety, each hollow needle is laterally spaced apart from the next needle by a distance of at least 2 inches and in some instances up to about 2 or 3 feet. This spacing has been necessary because of the complexity of the apparatus required to selectively feed one of the plurality of yarns for tufting by the hollow needle and then to remove the tufted yarn and replace it with another selected yarn to produce a change of color. The machine of the '383 Patent was limited by its antiquated yarn feed system, its needle construction and other issues including being low output (slow) and generating lots of waste (the yarn feed system was so antiquated, almost all products required tip shearing post tufting).

A disadvantage of this spacing is that for hollow needles spaced on 2 inch centers, it is necessary to sew 20 lateral stitches in order to complete one row of tenth gauge spaced stitching before the backing fabric can be advanced and another row of stitching begun. For even finer gauge stitches of one-sixteenth gauge spacing, 32 lateral stitches are required before advancing to the next row. In this instance, even if the tufting machine is achieving about 900 stitches per minute, the stitch rate is only sufficient to tuft roughly 28 stitches in the backing fabric per minute. Since high speed tufting machines using standard needles can tuft 1,500 rows of stitches per minute, the hollow needle machines are at a considerable speed disadvantage. Accordingly, the need exists to design a hollow needle tufting apparatus where the needles may be compactly spaced thereby permitting a row of yarns to be completed in a smaller number of stitches. For instance, if hollow needles can be spaced every half inch, it will be possible to complete a row of stitches in only one-fourth the time that is required when the needles are spaced two inches apart. The result is that the tufting machine will be able to produce four times the amount of finished carpet in the same amount of time.

Due to the circular nature of the hollow needles, and the cutting mechanism utilized where a knife blade slides across an angled cutting surface at the end of the hollow needle, as described in Ingram U.S. Pat. No. 4,991,523, also incorporated herein by reference in its entirety, it is critical that the needle be properly aligned so that the knife blade makes uniform contact across the angled cutting surface. While truing the needle position when needles are spaced two inches apart laterally has been possible with some patience, when the needle spacing is reduced, frequently an adjustment to one needle will loosen an adjacent needle. Therefore, a mechanism is needed to precisely orient closely spaced needles without undue manual adjustment.

In addition to difficulties in properly orienting closely spaced needles, the penetration of backing fabric by closely spaced needles tends to push the backing fabric downward resulting in yarn bights of uneven height and difficulties in implanting short yarn pile heights in the backing. The usual use of fingers extending from a backing support between needles is not practical in the case of hollow needle tufting apparatus due to the need to tuft a plurality of lateral stitches to create each row, which would drag tufted yarns across those needle fingers.

U.S. Pat. No. 7,318,383, incorporated herein by reference, attempted to address prior art deficiencies with a backing support having a crenellated rear edge. However, even with this improvement, the spacing of adjacent needles of 5/16" outer diameter was on ½ inch centers (or second gauge needles on a needle bar), still requiring 5 stitches to complete tenth gauge spaced stitching before advancing the fabric.

Also these prior art tufting needle's large size combined with the needle plate and machine configuration would typically produce a lowest loop height of at least about ½ inch above a backing. Attempt at tufting at a lower loop height failed. In fact, with the crenellated rear edge of the backing support, on the downstroke of a needle some backing would be pushed downwardly with the needle on the downstroke between the merlons, so that a total penetration of the needle on the downstroke, the length of yarn would be less than it is on the upstroke, when the backing would be pulled back up with the needle moving upwardly.

An improved narrow gauge hollow needle tufting machine is needed.

An improved hollow needle tufting machine capable of tufting a lower pile height is needed.

SUMMARY OF THE INVENTION

It is the present object of many embodiments of the present invention provide a narrow gauge hollow needle tufting machine utilizing hollow needles through which a plurality of colors might be introduced to a single specific needle.

It is another object of many embodiments of the present invention to provide an improved hollow needle tufting machine possibly utilizing smaller diameter needles than prior art designs, such as ¼ inch outer diameter hollow needles.

It is another object of many embodiments of the present invention to use a smaller diameter hollow needle in combination with a flat rear face of a backing support.

It is still another object of many embodiments of the present invention to provide a lowest pile height less than prior art carpet tufted with hollow needles, such as less than ⅜" if not about ¼".

Accordingly, a tufting machine of a presently preferred embodiment provides narrow gauge hollow needles in a way that has not been done in the prior art. Specifically, ¼ inch needles or other needles are employed preferably with polished surfaces and rounded edges so as to tend to deflect the weave and weft of a woven backing as opposed to breaking them so that after the needle penetrates the backing and retracts the backing tends to better hold the tufts. In addition to the needle diameter often being smaller and smoother (as opposed to rough angled, and/or sharp), the backing support bar preferably has a straight edge as opposed to a crenelated edge. By utilizing the new equipment, a new product having a lowest pile height lower than prior art designs has been achieved with great success. This gives a new capability to provide a whole new line of products not previously possible. This line of products is different from yarn color placement technology such as described in U.S. Pat. Nos. 8,141,505 and 8,359,989, incorporated herein by reference. There is no significant yarn waste carried on the backside of the carpet. Accordingly, for a given face weight of yarn, the total yarn used can be on the order of at least 10% less if not almost half as much yarn. This can be a huge savings.

BRIEF DESCRIPTION OF THE DRAWINGS

The particular features and advantages of the invention as well as other objects will become apparent from the following description taken in connection with the accompanying drawings in which.

DETAILED DESCRIPTION OF THE DRAWINGS

Figure 1:
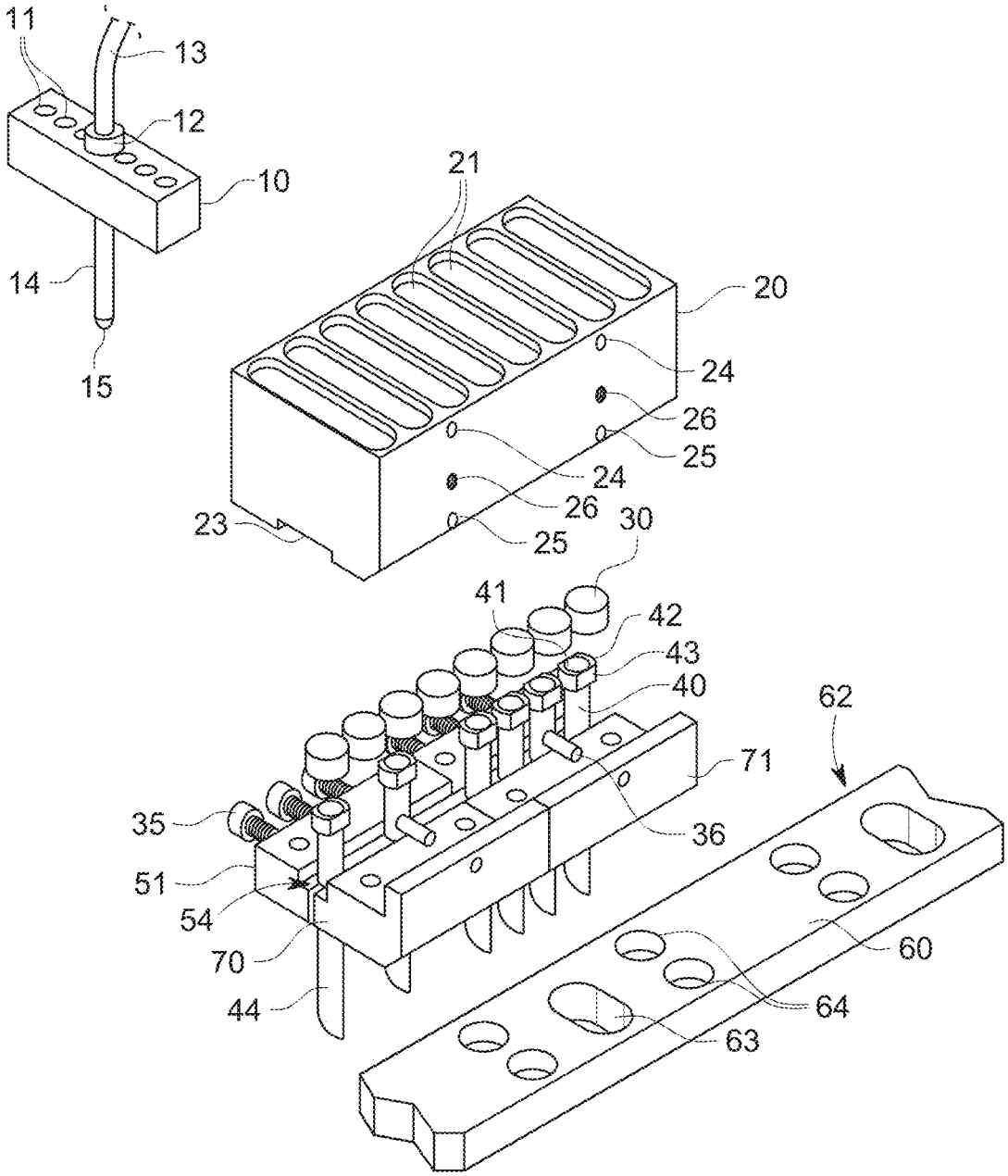
FIG. 1 is an exploded view of an embodiment of a narrow gauge hollow needle tufting assembly of the present invention.

Turning first to FIG. 1, a cover plate 10 is shown with a yarn feed openings 11 proceeding in a longitudinal row. While the illustrated cover plate has six yarn feed openings, the alternative plate designs could be designed with two, four or eight yarn feed openings 11. Through a central opening in cover plate 10 is collar 12 which receives an air supply line 13 at its upper end and it connects to tube 14 at its lower end, enabling the tube 14 to guide air downward to its outlet 15. Cover plate 10 fits over a longitudinal tapered slot 21 in frontal block 20. It will be appreciated that cover plate 10 rather than being designed to cover a single slot 21 could be made wider with longitudinal rows of yarn feed openings to cover a plurality of slots. In operation, yarns extend downward through openings 11 of the cover plate into a slot 21 of funnel block 20 and downward directed air pressure through openings 11 and gravity, keeps the yarns downwardly entrained within slot 21 and the jet of air proceeding from outlet 15 is designed to rapidly encourage a selective yarn downward and into the annular opening 41 of hollow tufting needle of 40 positioned beneath a selected tapered slot 21.

The funnel block 20 also has a bottom channel 23 which allows some downwardly directed air flow to escape laterally rather than proceeding through the hollow needles of 40. Funnel block 20 also has lower pin holes 25 for mounting with pins 36 to front needle holder blocks 50, in addition to central threaded openings 26 and upper pin holes 24 for fastening purposes. At the bottom of slot 21 as cylindrical inserts 30 are inset and the funnel block 20 is mounted over hollow needle heads 42 so that the openings at the bottom tapered slots 21 ending in cylindrical inserts 30 are directly positioned over the openings 41 of hollow needles of 40. The heads of hollow needles 40 have at least one or more planar side 43, and in the illustrated embodiments have a pair of parallel opposed planar sides to facilitate alignment. Specifically, rear needle holder blocks 51 and front needle holder blocks 50 are joined by threaded allen bolts 35 in a fashion that leaves a channel 54 extending laterally across their joined upper surface. The channel 54 is defined by opposed planar sides. The opposed planar surfaces 53 of the heads 42 of hollow needles 40 align with the planar sides of the channel 54 to require the hollow needles 40 to be positioned so that the angled cutting surface 44 of needles 40 is precisely aligned in a rearward facing direction. With the two opposed planar surfaces 43 it will be seen that the angled cutting surface 44 could be aligned with the cutting surface 44 facing either directly forward or directly rearward, however the rearward direction is selected so that the cutting surface 44 can properly interface with knives 47, shown in FIG. 2.

Backing fabric for tufting is fed over backing support bar 60. Unlike prior backing support bars used with hollow needles, the backing support bar of the present invention 60 may not have a series of merlons which are aligned to extend rearward between hollow needles 40 to about the mid-point of those needles. Some embodiments may have the merlons. The merlons tend to allow some backing to be automatedly directed with the needle 40 on the downstroke so that less yarn is tufted on the downstroke than the upstroke when the needle 40 is retracted from the backing 75. The length of prior art merlons with respect to the interspaced arcuate hollows or crenels was about equal to the radius of the hollow needles 40 and the merlons supported the backing fabric against the downward pressure applied when angled surfaces 44 penetrated the backing fabric to insert stitches of yarn. These merlons may not be necessary for all embodiments and a straight face or edge 62 may be preferable with at least some hollow needles 40.

Figure 2:
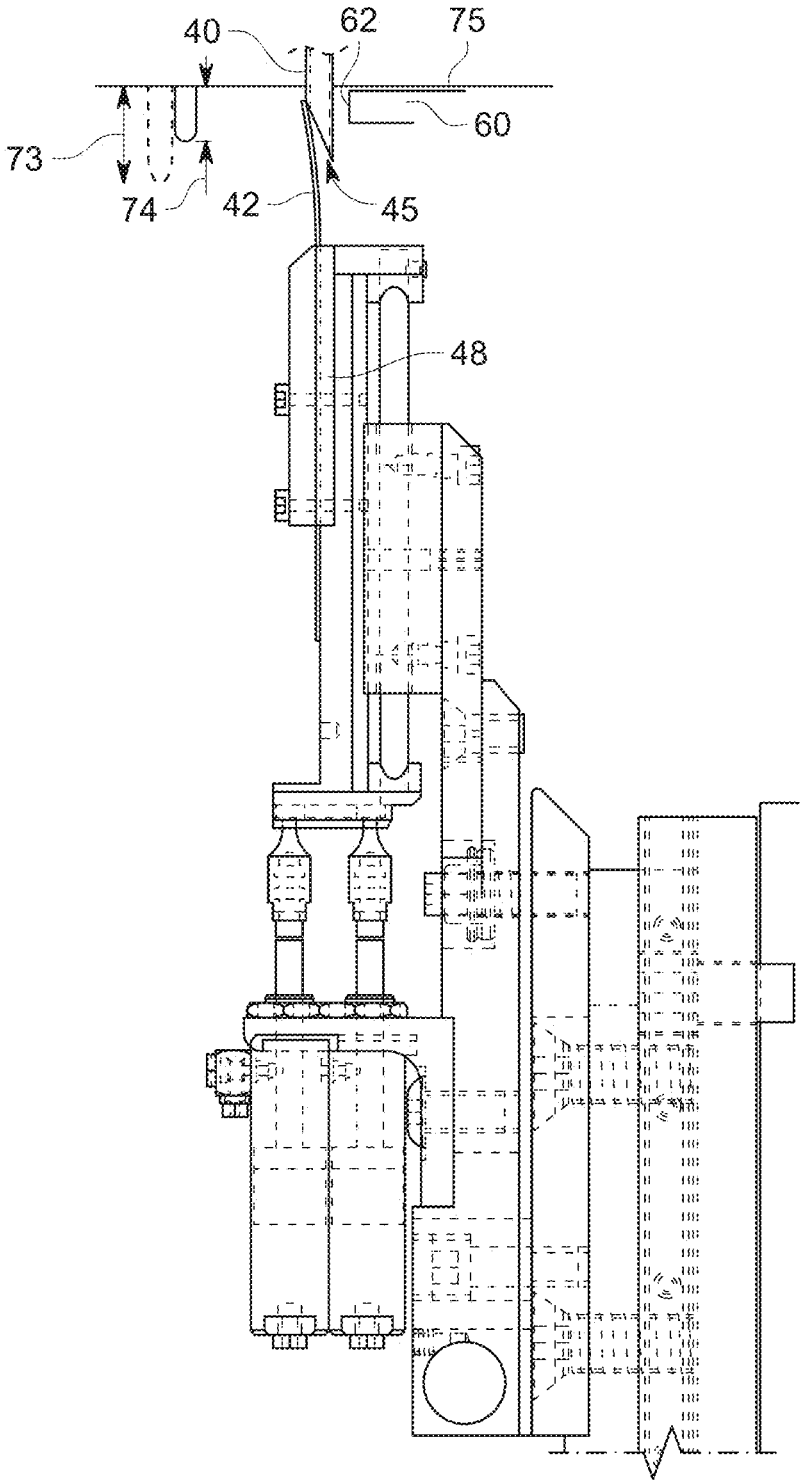
FIG. 2 is a side plan view showing relationship of a hollow needle of the backing support plate.

FIG. 2 illustrates the backing support bar 60 utilized with closely spaced hollow needles 40 of the present invention. The backing support bar 60 may have openings 64 and slots 63 (shown in FIG. 1) for mounting above the knife bar 48 which holds a plurality of laterally spaced knives 47. Backing fabric passes over backing support bar 60 which supports between hollow needles 40 which penetrate the backing fabric. The downward tip 40 of the cutting surface 44 of needle 40 penetrating the backing fabric is spaced from a rear edge of the backing support bar 60, but could be adjacent to, if not contacting it. In this fashion, backing support plate 60 provides support to the backing fabric and may assist in preventing the backing fabric from bending downward upon stitching and causing irregular heights in the resulting tufts of yarn or the complete inability to tuft short yarn height stitches. Preferably the backing support 60 may be shifted laterally for many embodiments as backing shifting.

In this fashion, by providing a backing support bar 60 with a straight edge 62 and a narrower gauge hollow needle may be effectively implemented in a way for some embodiments to achieve a shorter pile height than prior art machines, possibly by spacing of ½ inch centers, or otherwise.

FIG. 1 shows at least two options for needle bars 70,71 which could easily be utilized for the preferred embodiments. Specifically, needle bar 71 could be ¼ inch outer diameter hollow needles (as opposed to $5/16^{th}$ inch needles of prior art designs) possibly spaced at ⅓ inch centers as opposed to ½ inch centers as prior art designs. It may be also possible to provide the ¼ inch needles spaced apart on ⅔ of an inch centers or ½ inch centers, or other spacing, depending on the width of the needle bars 70,71 such as shown in needle bar 70.

With various constructions, an ability, whether it be closer needle spacing as shown in module 71, the same, or wider needle spacing as shown in nodule 70, an ability to tuft shorter pile heights as illustrated in FIG. 2 than prior art machines can be provided by the preferred embodiments due to a combination factors as will be discussed herein.

Specifically, FIG. 2 shows the pile height 73 of a prior art tufting machine relative to the pile height 74 is shown roughly half of the pile height 73 for at least some preferred embodiments. In order to achieve this short pile height 74 which is on the order of about ¼ inch as opposed to a smallest pile heights 73 of prior art designs being no less than about ½ inch, a number of factors involved. Specifically, instead of having a crenelated rear face of prior art designs, a flat or straight face or edge 62 may be employed on the backing bar 60, although possibly crenelated surfaces can be utilized in still other embodiments. The backing 75 can close more quickly with a smaller diameter needle 40 than with a larger diameter needle thus permitting a smaller pile height 74 than prior designs. The shear edge or face 62 may also assist in having the ability for the backing 75 to close more quickly.

The straight edge 62 is believed to allow for more spreading of the backing than a crenellated edge of prior art designs so that when narrower gauge needles (like ¼ inch) penetrate the backing 75, while the backing 75 does sag, it does so more uniformly than with a crenellated edge and thus allows for a more uniform loop to be provided through the backing 75.

Additionally, needles 40 have been significantly improved over prior art needles. The surface finish has been reduced from a 32 RA to a 16 RA which is a much more polished surface. The smoother surface passes through backing 75 material more smoothly without catching and breaking wefts or warp nearly as often as prior art needles. Furthermore, the "point" at the end of the needle has been polished or rounded to a radius of curvature somewhat close to 0.004" (4 thousandths of an inch). The edges of the needle at the opening are also polished to a similar degree. Thus, the edges and point are rounded at least more than 0.00005 (one twenty thousandth, preferably more than one ten thousandth) so that they tend to cut wefts or warp much less than the angled prior art needles, and instead spread the weave apart where the needle 40 penetrates the backing 75.

Furthermore, Propex has launched a new brand of polyester dimensionally stable woven backing that tends to separate more effectively between the weft and warp as the needle passes beside rather than tending to break those fibers. Of course, some needle strokes are directly on top of one or the other of the weft/weave yarns and they still can break on occasion, but much less than with prior art backing. These new backings are believed to assist with the new hollow needle technology improvements to be used in commercial carpet applications including broadloom, narrow width broadloom, and carpet tiles.

Accordingly, the applicant can consistently now tuft a shortest pile height 74 of less than ⅜ of an inch if not about ¼ inch. This is much shorter than ½ inch minimum pile heights of prior art machines. This smaller pile height can accommodate different types of uses than the prior art designs which may make this technology particularly attractive in the marketplace for at least some applications. Of course, this machine could also tuft longer pile heights such as the prior art 73 in addition to the low pile height 74 shown in FIG. 2 (or others) such giving rise to a range of possible patterns not previously known in the prior art. Once a backing 75 is tufted, it can be coated with less coating such as latex, thermoplastic, precoat etc. since there is similarly less yarn on the backstitch, particularly when compared to LCL options like Colorpoint, Colortec, etc., like shown in U.S. Pat. Nos. 8,141,505 and 8,359,989 using 'yarn color placement' technology. The coater also runs at a slower speed to apply and cure the back coating material due to the relatively large amount of yarn carried on the back surface.

In fact, depending on the tufted gauge, the number of yarns, a savings of at least ten percent to up to almost half as much yarn can be used for a given face weight of yarn using the new methodology over prior art color placement options since those machines carry unused yarn on the back of the design while the hollow needle machines do not. The more colors used, the greater the savings. This savings of yarn for a specific face weight of yarn (weight of yarn on the visible side of the backing) can very quickly pay for new tufting machines for manufacturers, and result in larger profits for those manufacturers.

Figure 3:
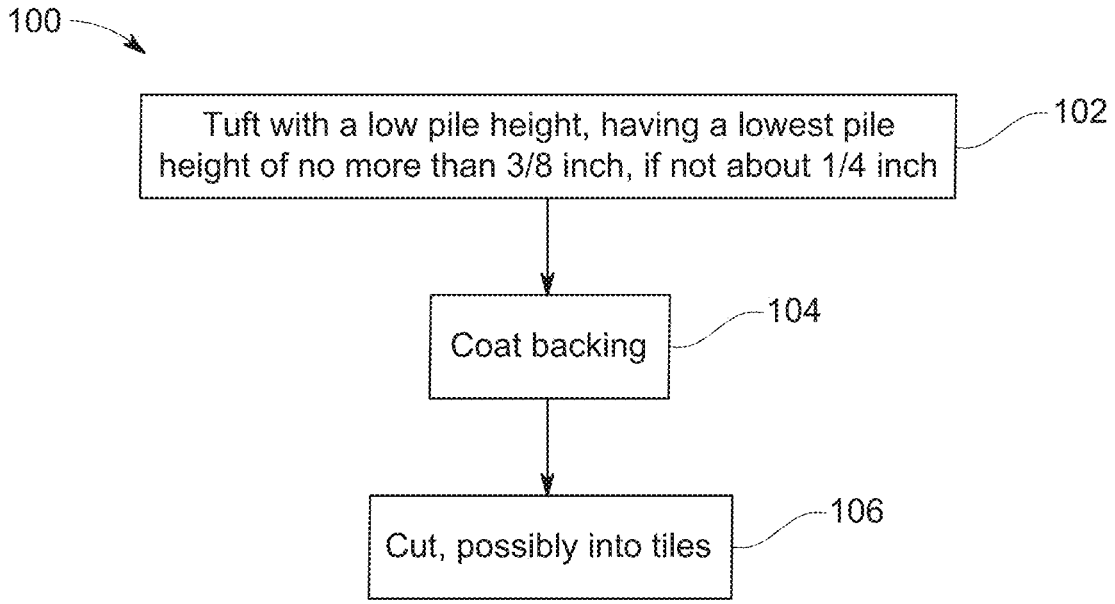
FIG. 3 is a flow chart showing product by process manufacturing of new tufted goods using the methodology and machinery disclosed herein.
Figure 4A:
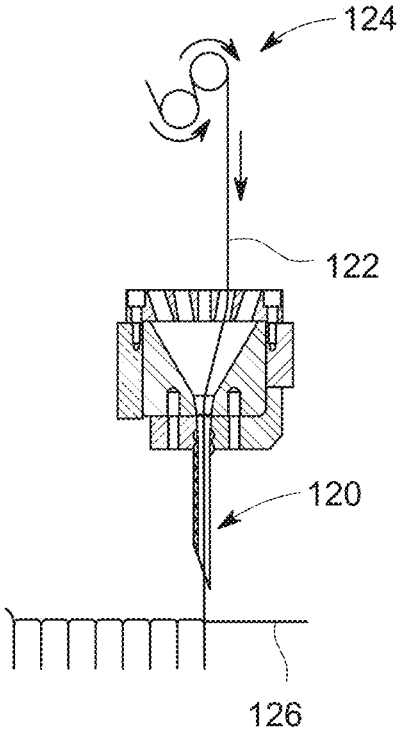
FIG. 4 shows progression of tufting, and non-tufting, with a hollow needle tufting assembly of the preferred embodiments.
Figure 4B:
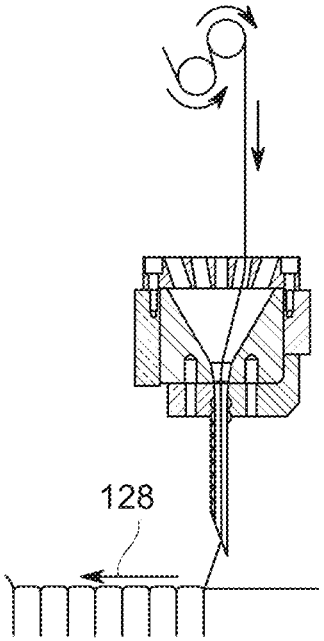
Figure 4C:
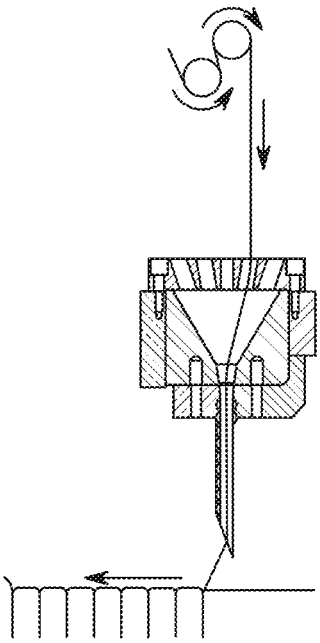
Figure 4D:
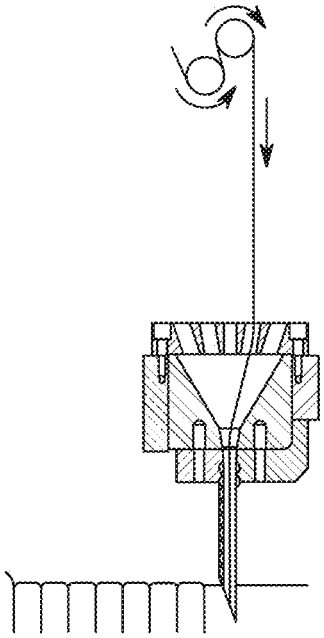
Figure 4E:
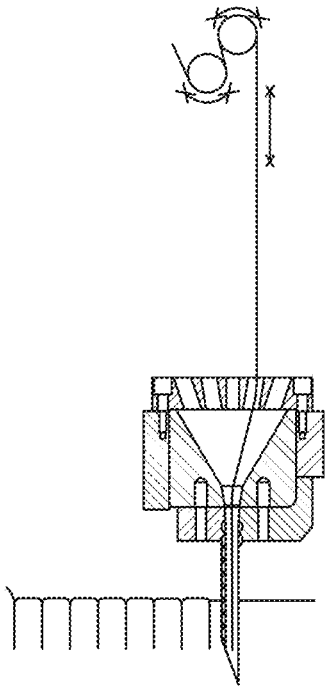
Figure 4F:
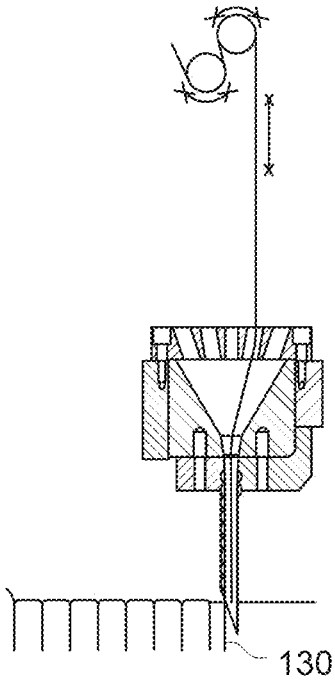
Figure 4G:
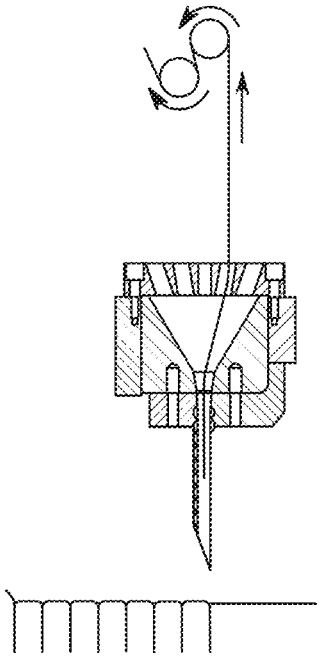
Figure 4H:
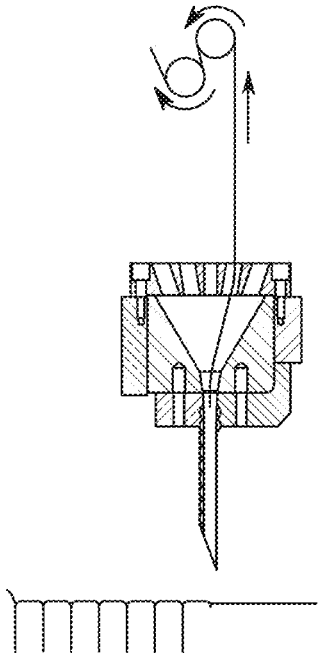

FIG. 3 shows a flowchart of a method 100 of producing products. Specifically, the carpet is tufted in step 102 preferably having a lowest pile height of no more than ⅜ of an inch if not about a ¼ inch utilizing the equipment shown and described herein. These pile heights are lower than any produced in the market today with hollow needle tufting machines. After tufting the carpet in step 102, the backing is coated in step 104 which can be with less coating material in many product designs particularly the CMC machines of U.S. Pat. Nos. 8,141,505 and 8,359,989 which provide yarn color placement technology. Coatings can include thermoplastics, polyvinyl chloride, latex or other backings. A lower amount of coating can be applied to lower the weight of the product since less yarn is present on the backside of the backing 75 as backstitches. After coating, curing can be much quicker since there is less material being utilized, the tiles and/or carpet can be cut in step 106 to provide product for use/sale. Through this process, a product by process can be achieved which has not capable of being provided in the marketplace with prior art equipment.

FIG. 4 shows a progression of a hollow needle 120 shown connected to a single yarn 122, it being understood that multiple yarns 122 would likely be fed separately through a single hollow needle 120. Yarn feed system 124 is shown assisting and feeding and retracting the yarn 122 through the hollow needle 120. The progression begins at the top left at (a), proceeds to the right to (d) and then continues from the bottom left at (e) to the bottom right at (h). Backing 126 is shown being fed in the direction 128 relative to the hollow needle 120 at (a) showing the top of a needle stroke (b) shows the start of the advancing of the backing along with the feeding of the yarn 122 by the yarn feed system 124. The needle 120 begins moving downwardly at (c) and then penetrates backing 126 at (d). As the yarn continues to be fed at (e) a yarn 122 with needle 120 has been fully inserted. The yarn 122 is likely then cut with a knife (not shown) at the needle 120. The needle 120 then begins retracting at (f) leaving the stitch 130 remaining extending from the backing 126. At (g) yarn 122 is being retracted relative to the needle 120 where it continues being retracted at step (h) presumably for another color and/or type of yarn to start being inserted for another stitch to be provided through the needle 120.

Figure 5:
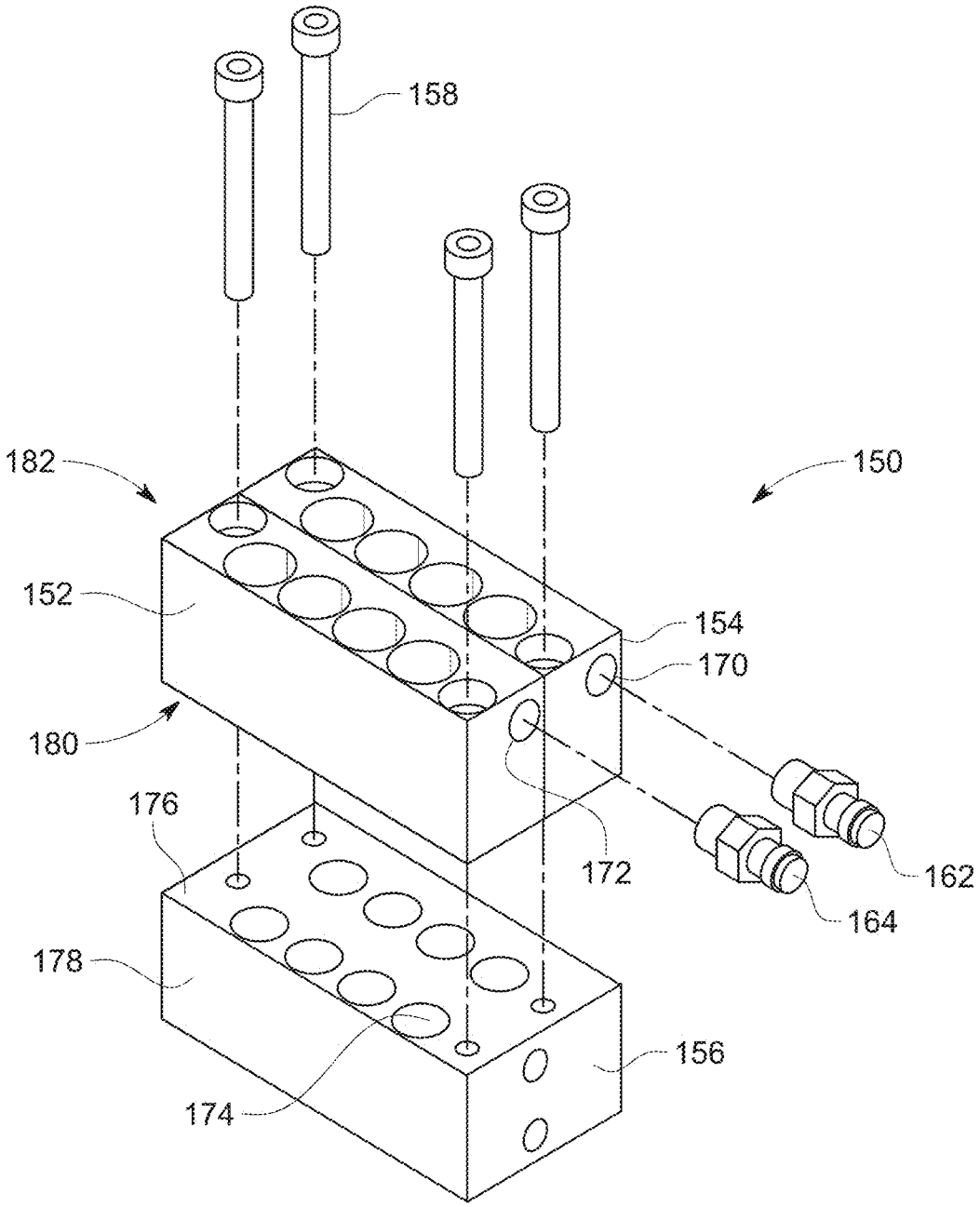
FIG. 5 is an exploded view of a tunnel block of a presently preferred embodiment.

FIG. 5 shows an improved funnel block 150 replacing funnel block 20 of FIG. 1. First and second upper portions 152,154 may be extremely similar in construction to one another and disposed side by side together and then placed on a bottom portion 156. Bolts 158 may assist in connecting the assembly together. Constructing the funnel block 150 in portions has a number of advantages.

Figure 6:
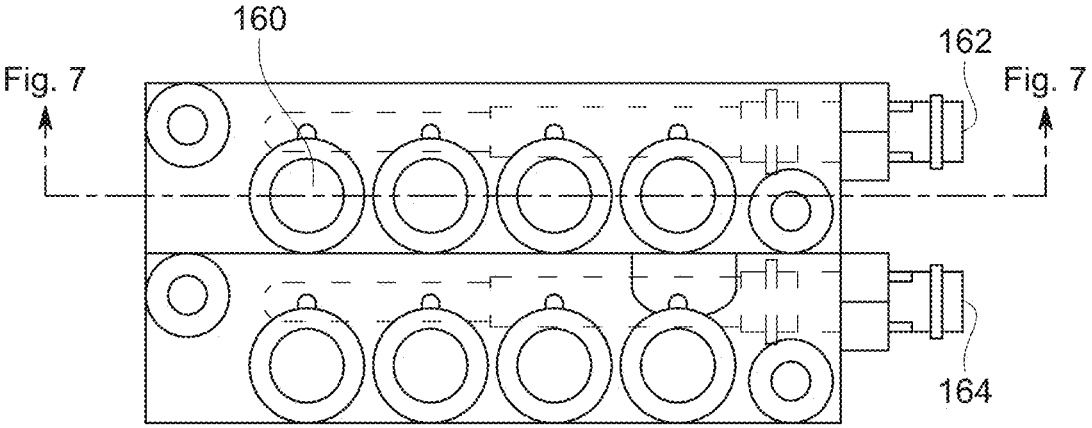
FIG. 6 is a top plan view of the tunnel block of FIG. 5.

FIG. 6 shows a top view of the eight channels 160 through which yarn may pass along with air supply fittings 162,164 which are preferably connected to an air supply for selectively directing air through ports 166,168, etc., within the upper portions 152,154 so as to selectively direct yarn through the channels 160 as appropriate to appropriate needles 120. Air fed to the fittings 162,164 can be done in conjunction with operation of the yarn feed system 124 so as to selectively provide a desired yarn 122 to the desired needle 120 utilizing the air and the yarn feed systems 124 such as that shown in FIG. 4 and/or others.

Figure 7:
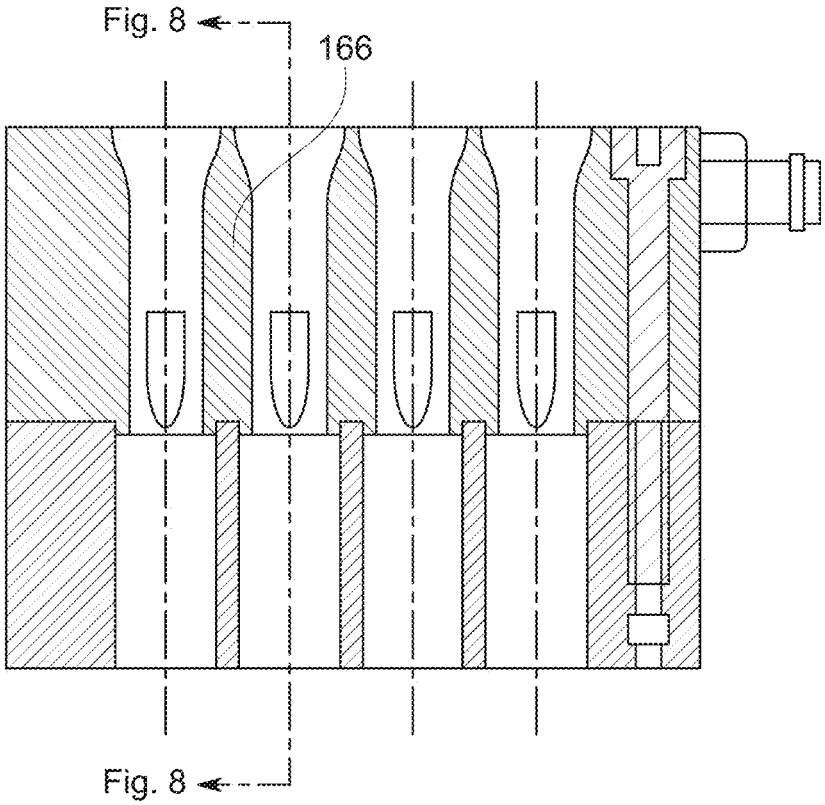
FIG. 7 is a cross section view taken along the line AA of FIG. 6.
Figure 8:
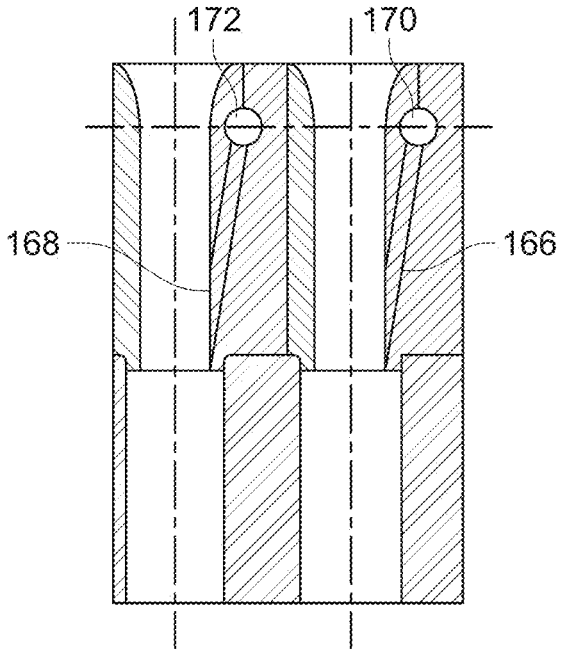
FIG. 8 is a cross sectional view taken along the line BB of FIG. 7.

As one can see from FIGS. 7 and 8, the ports 166,168 can be machined at angles so as to intersect the channels 160 as well as bores 170,172 which communicate air to all of the channels 160. By providing the upper portions 152,154 separate from the bottom portion 156, the ports 166,168 may be more easily machined into those upper portions 152,154 as opposed to starting air channels mid-way up within an overall funnel block 20 which could be a particularly difficult construction to manufacture. Examining the cross sections in FIG. 7 FIG. 8 as well as the bottom portion 156 in FIG. 5, one would see that those bottom channels 174 are cylindrical from top 176 to bottom 178 of the bottom portion 156. The air ports 166,168 contact the channels 160 as well as the bores 170,172 and thus communicate air from the air supply through fittings 162,164 selectively through the bores 170,172 to the appropriate channel(s) 160 to act in combination with the yarn feed system 124 to selectively direct the desired yarn 122 to the desired needle 120. Providing top portions 152,154 in combination with the bottom portion 156 is desirable to assist in machining the ports 166,168.

Specifically, the air ports 166,168 can begin being machined relative to the channel 160 for many embodiments at a bottom 180 of each of the first and second upper portions 152,154 at an angle such as an acute angle relative to the channels 160 and continue until contacting the bores 170, 172 so as to provide downward and angled flow of air into the channel 160 when air is selectively provided from a supply through the fittings 162,164 as would be understood from the images. The ports to do extend completely from the bottom 180 to the top 182 of the first and second upper portions 152,154, but instead terminate internal to the upper portions 152,154 in or at the bores 170,172, in fluid communication therewith. The upper portions 152,154 are then connected to bottom portion 156 to form the funnel block 150 with aligned channels 160 for many embodiments.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method of using a tufting machine having a yarn feed selectively supplying any one, and only one at a time, of a plurality of a selection of yarns respectively to each of a plurality of reciprocating laterally spaced hollow needles having heads and opposed angled ends, wherein a selected one of the plurality of yarns is fed into the head of a hollow needle and tufted by reciprocal movement of the needle through a weave of backing fabric fed from front to back over a backing support, the selected one yarn exiting the angled end of the hollow needle being cut by a knife cooperating with the angled end to leave a yarn bight in the backing fabric, said improvement comprising the steps of:

(a) providing hollow needles having a diameter of less than ⅜ inch; and (b) at least one of rounding edges of the hollow needles and polishing the needles whereby the needles tend to deflect the weave of the backing fabric rather than breaking fibers of the backing fabric; and (c) tufting a pattern having a uniform low loop height, and when tufting, producing the uniform low loop height consistently, said uniform low loop height no more than ⅜ inch, and said production occurring in the absence of a backing plate below the backing in a plane with the laterally arranged needles.

2. The method of claim 1 wherein the diameter of the needles is no greater than ¼ inch.

3. The method of claim 1 wherein the backing support has a straight edge.

4. The method of claim 1 wherein the hollow needles are spaced laterally at intervals less than 2 inches.

5. The method of claim 4 wherein the hollow needles are spaced laterally at about ½ inch.

6. The method of claim 4 wherein the hollow needles are spaced at ⅓ inch.

7. The method of claim 1 wherein in the step of tufting, the uniform low loop height is no more than ¼ inch.

8. The method of claim 1 wherein the needles are polished to less than 24 RA.

9. The method of claim 8 wherein the needles are polished to 16 RA.

10. The method of claim 1 wherein the hollow needles have points rounded to at least 4 thousandths of an inch curvature.

11. The method of claim 1 wherein the hollow needles have edges rounded to at least one twenty thousandth of an inch.

12. The method of claim 1 wherein the backing fabric is a dimensionally stable woven backing.

13. The method of claim 1 wherein the uniform low loop height is no more than ¼ inch.

14. The method of claim 1 further comprising the step of coating the backing after tufting.

15. The method of claim 1 further comprising a funnel block having first and second upper portions adjacently disposed above a bottom portion, with the first and second portions machined to provide air ports at angles to contact channels with the air ports communicating with an air supply through bores.

16. The method of claim 15 wherein the air ports are machined beginning at a bottom of the first and second upper portions to connect the channels with the bores.

17. The method of claim 16 wherein the air ports terminate within the upper portions.

18. A method of using a tufting machine having a yarn feed selectively supplying one of a plurality of separately fed yarns respectively to each of a plurality of reciprocating laterally spaced hollow needles having heads and opposed angled ends, wherein a selected one of the plurality of yarns is fed into the head of a hollow needle and tufted by reciprocal movement of the needle through a weave of backing fabric fed from front to back over a backing support, the selected one yarn exiting the angled end of the hollow needle being cut by a knife cooperating with the angled end to leave a yarn bight in the backing fabric, said improvement comprising the steps of:

(a) providing hollow needles having a diameter of about ¼ inch; and (b) at least one of rounding edges of the hollow needles and polishing the needles whereby the needles tend to deflect the weave of the backing fabric rather than breaking fibers of the backing fabric; and (c) tufting a pattern having a uniform low loop height, and when tufting, producing the uniform low loop height consistently, said uniform low loop height no more than ⅜ inch, and said production occurring in the absence of a backing plate below the backing in a plane with the laterally arranged needles.

* * * * *